United States Patent [19]

Sluyterman et al.

[11] Patent Number: 4,885,502

[45] Date of Patent: Dec. 5, 1989

[54] DEFLECTION UNIT FOR USE IN A PROJECTION TELEVISION DISPLAY TUBE

[75] Inventors: Albertus A. S. Sluyterman; Nicolaas G. Vink, both of Eindhoven, Netherlands

[73] Assignee: U.S. Philips Corporation, New York, N.Y.

[21] Appl. No.: 162,521

[22] Filed: Mar. 1, 1988

[30] Foreign Application Priority Data

Mar. 24, 1987 [NL] Netherlands ..... 8700684

[51] Int. Cl.[4] ..... H01J 29/70

[52] U.S. Cl. ..... 313/431; 313/440; 313/421; 335/210; 335/213

[58] Field of Search ..... 313/431, 440, 421; 335/210, 213

[56] References Cited

U.S. PATENT DOCUMENTS 4,420,734 12/1983 Shimizu et al. ..... 335/213

4,433,318 2/1984 Okuyama et al. ..... 335/213

*Primary Examiner*—Ulysses Weldon

*Assistant Examiner*—Michael Horabik

[57] ABSTRACT

An electromagnetic deflection unit for use in a projection television display tube, includes: a system of line deflection coils having two oppositely located saddle coils each with their longitudinal conductor groups which are to be positioned on either side of the longitudinal axis of the display tube. At the screen-sided end the conductor groups of the oppositely located saddle coils are located at a first distance, on one side of the tube axis and on the other side they are located at a second, smaller distance from each other, whereas at the gun-sided end the situation is just the reverse. The distances at the screen-sided end are adjusted to generate a 4-pole component upon energization of the line deflection coil system, which component renders the raster to be written on the display screen trapezoidal. The distances at the gun-sided end are adjusted to generate a 4-pole component which is opposite to the 4-pole component generated in the proximity of the screen-sided end.

5 Claims, 2 Drawing Sheets

DEFLECTION UNIT FOR USE IN A PROJECTION TELEVISION DISPLAY TUBE

The invention relates to an electromagnetic deflection unit for use in a projection television display tube having a display screen facing an electron gun, comprising.

A system of line deflection coils deflect the electron beam in the display tube in the horizontal direction; system includes two oppositely located saddle coils each having longitudinal conductor groups which are to be positioned on either side of the longitudinal axis of the display tube.

Large-screen TV sets having screen diagonals of 40 inches or more are commercially available. These sets generally comprise three separate cathode ray tubes (red, green and blue, respectively) which are arranged side by side (or above one another) each with their own lens system and whose pictures are projected from the rear onto a viewing screen in such an arrangement that they form a complete colour picture, with the pictures in the three colors being correctly in register. Each of the cathode ray tubes used is provided with a system of deflection coils comprising coaxially arranged line and field deflection coils for scanning the raster in two orthogonal directions. If no special measures are taken, the red, green and blue pictures projected on the screen will be trapezoidally different. This can be corrected by winding the line deflection coils of the outer cathode ray tubes in such a way that, when energized, these coils generate a 4-pole component with a given orientation. It has been found in practice that the raster geometry on the screen can be amended in this way, but this is at the expense of the spot quality.

SUMMARY OF THE INVENTION

At the screen end of the deflection unit the conductor groups of the oppositely located saddle coils of the line deflection coil system are located on one side of the tube axis at a first distance from each other and are located at a second, smaller distance from each other on the other side. At the gun end the situation is just the reverse, the distances at the screen end being adjusted to generate a 4-pole component upon energisation of the line deflection coil system, which component renders the raster to be written on the display screen trapezoidal, and the distances at the gun end being adjusted to generate a 4-pole component which is opposite to the 4-pole component generated in the proximity of the screen end.

With the above-described line deflection coil arrangement, the desired raster correction is obtaind by generating a 4-pole component on the screen side, while at the gun side an opposite 4-pole component is generated. This component does not have any influence on the raster correction, but it does compensate for the unfavourable influence on the spot quality produced by the 4-pole component on the screen side.

The saddle coils of the line deflection coil system are preferably formed in a yoke-winding technique.

BRIEF DESCRIPTION OF THE DRAWING

A preferred embodment of the invention will now be described in greater detail with reference to the accompanying drawings, in which.

DETAILED DESCRIPTION OF THE PREFERRED EMBODIMENTS

Figure 1A:
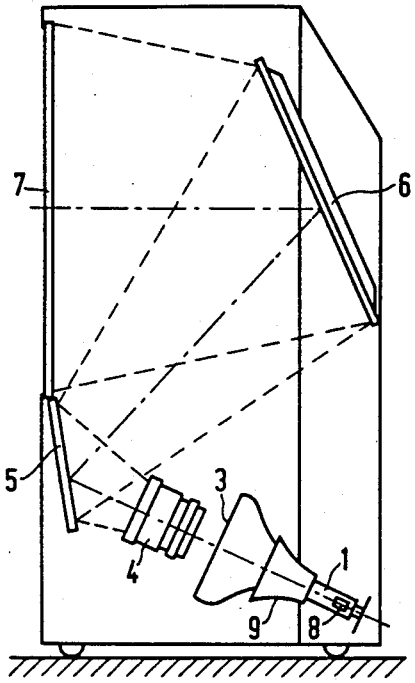
FIG. 1*a* shows a typical lay-out of a projection television device.
Figure 1B:
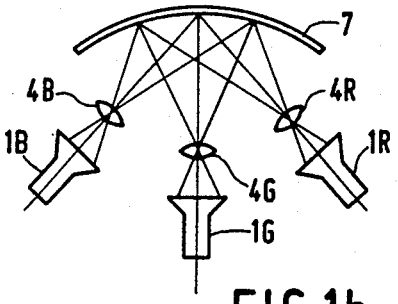
FIG. 1*b* shows the arrangement of the blue, green and red display tubes in such a device.
Figure 1C:
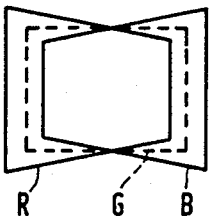
FIG. 1*c* shows the rasters produced by these display tubes and projected on a screen from the position of the central (green) display tube.
Figure 2:
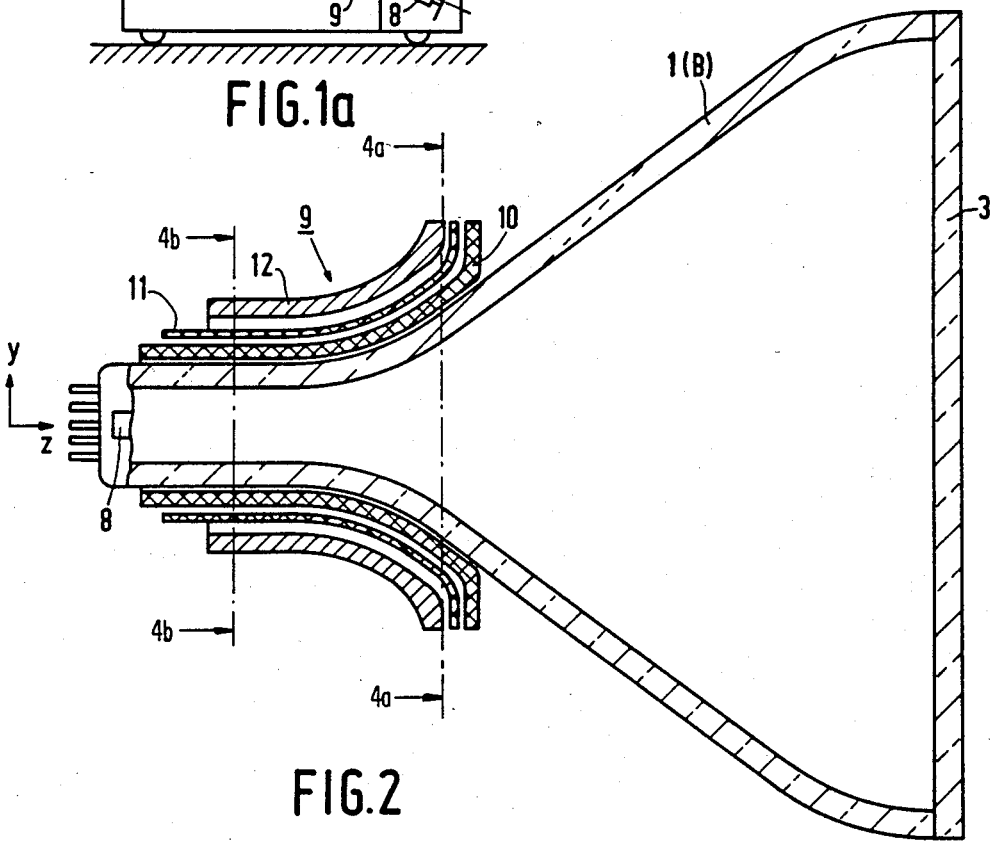
FIG. 2 is a diagrammatic longitudinal section of a cathode ray tube to be used in the device of FIG. 1 with a deflection unit according to the invention.

FIG. 1*a* shows a free-standing cabinet comprising a television display system provided with a cathode ray tube 1 having a display screen 3, a projection lens system 4, mirrors 5 and 6 and a translucent projection screen 7. In colour television three cathode ray tubes 1B, 1G and 1R, and three lens systems 4B, 4G, 4R are used which are located in a plane at right angles to the plane of the drawing (FIG. 1*b*). The mirrors 5 and 6 extend, for example, so far in the direction perpendicular to the drawing that they can receive light from all three cathode ray tubes. The outer cathode ray tubes 1B and 1R are directed inwards in order to cause the projected red, blue and green rasters R, G, B to coincide on the screen 7. These rasters will be trapezoidally different (FIG. 1*c*). This can be compensated by causing the line deflection coils of the outer cathode ray tubes 1B and 1R to generate a 4-pole field component on their screen side. The way in which this can be realized without spot deterioration will be described with reference to the cathode ray tube 1 (B) shown in a longitudinal section in FIG. 2. The cathode ray tube has an electron gun 8 on the side facing the display screen 3.

On its path to the screen 3 an electron beam produced by the electron gun 8 is deflected by means of a deflection unit 9 in two orthogonal directions: the line deflection direction (x) and the field deflection direction (y). As is shown in detail in FIG. 2, deflection unit 9 according to the invention includes a line deflection coil 10 and a field deflection coil 11 which are arranged coaxially with respect to each other on the display tube 2. An annular core 12 of a soft magnetic material is arranged coaxially around the line deflection coil 10 and the field deflection coil 11 which in this case are both of the saddle type with flatly positioned rear-end connection parts. This annular core 12 may either consist of one part, as is shown in the Figure, or it may consist of two parts if a (field) deflection coil is toroidally wound thereon.

Figure 3:
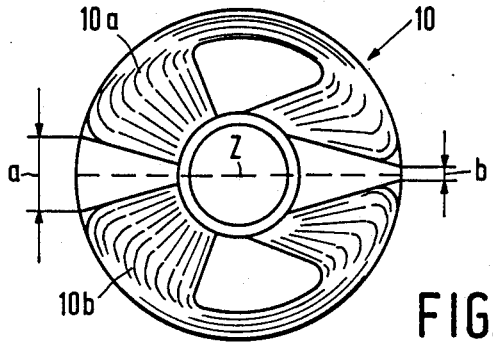
FIG. 3 is an elevational view of the line deflection coil 10 of the deflection unit for a blue display tube.
Figure 4A:
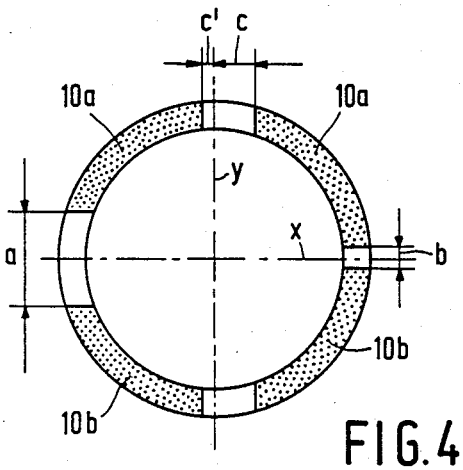
FIG. 4*a* shows the circumferential distribution of the longitudinal conductor groups of the line deflection coil 10 at its screen end.
Figure 4B:
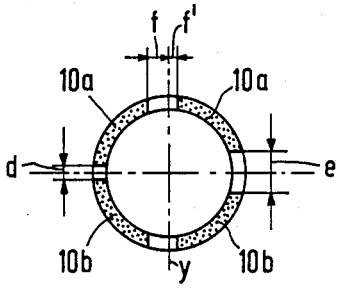
FIG. 4*b* shows the circumferential distribution of longitudinal conductor groups of the line deflection coil 10 at its gun end.
Figure 5:
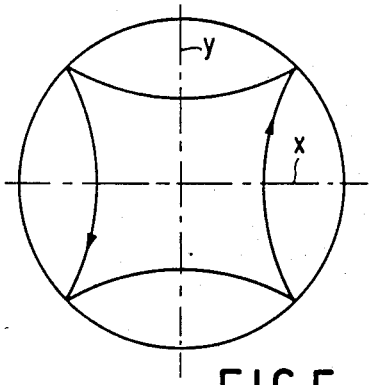
FIG. 5 shows the four-pole field component which is generated by the line deflection coil 10 on its screen side in the cathode ray tube of FIG. 2.
Figure 6:
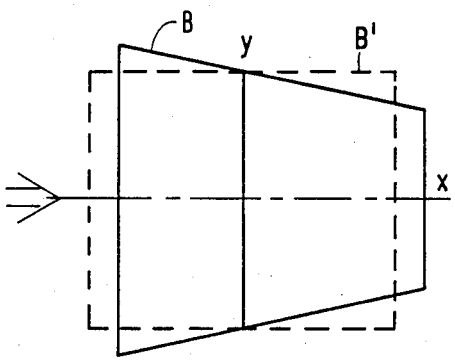
FIG. 6 is an elevational view of the (trapezoidal) raster of a display tube including a deflection unit with a line deflection coil according to FIG. 2 and the (straight) raster B' obtained by projection on a screen.

Line deflection coil 10 has a special asymmetry. As is shown in FIG. 3, which is an elevational view of line deflection coil 10 the line deflection coil 10 comprises two halves 10*a* and 10*b*. The longitudinal conductor groups thereof are located at a distance a from each other on the screen side of the line deflection coil 10 at one end of the tube axis z and on the other side of the tube axis z they are located at a (smaller) distance b from each other. As has been indicated by the difference in the distances c and c' between the conductor groups and the central axis y (FIG. 4*a*), the centre of the windows of the line deflection coil halves is preferably located on the front side of the line deflection coil 10 on the right-hand side of the central axis y. This location enhances the envisaged effect. The distances a, b, c and c' are adjusted in such a way that, when the line deflection coil 10 is energized, this coil generates a sufficiently strong 4-pole field component at its screen end. See FIG. 5. This 4-pole produces a trapezoidal raster distortion (shown by means of a solid line in FIG. 6) on the display screen 3 of the tube 1B. The trapezoidally distorted raster B (obliquely) projected on the viewing screen 7 via lens 4B thereby acquires the shape of a rectangle B' (shown by means of a broken line in FIG. 6). Analogously, the raster R (FIG. 1*c*) of the other outer (red) cathode ray tube 1R (FIG. 1*b*) can be corrected. This means that in this case the line deflection coil is given an asymmetry which is 180° inverted with respect to the asymmetry of the line deflection coil 10 shown in FIG. 3. This means that in this case the distance between the conductor groups of the coil halves at the screen end is small on the left-hand side of the coil and it is large on the right-hand side, and that the centre of the windows of the line deflection coil halves at the screen end is preferably located on the left-hand side of the central axis y. However, if no further measures were taken, the spot quality would be detrimentally influenced. In order to compensate this detrimental effect, the line deflection coil 10 of the "blue" display tube 1(B) is wound in such a way tht at its gun end it has an asymmetry in the circumferential distribution of the longitudinal conductor groups which is opposite to the asymmetry on its screen side. This is shown in FIG. 4*b*. The distances d, e, f and f' are adjusted in such a way that, upon energization, a 4-pole field component is generated at the gun end which is opposite to the 4-pole field component at the screen end. This 4-pole field component has no influence on the raster correction, but compensates the detrimental influence of the screen-sided 4-pole field component on the spot quality. Thus it is achieved that the raster distortion on the viewing screen is corrected without a disturbing extent of spot distortion being introduced. Analogously the line deflection coil of the "red" cathode ray tube 1(R) at its gun end has an asymmetry in the distribution of the longitudinal conductor groups which is opposite to the asymmetry on the screen end.

It will be evident that the saddle-shaped line deflection coil halves 10*a* and 10*b* cannot be wound on one and the same mandrel. (This could be done with coils in which the distances a and b remain constant throughout their length and these coils are then mounted in a mirrored configuration). To avoid the need for 2 mandrels, the yoke-winding technique described in US-A 4,484,166 can be used advantageously.

In this case the line deflection coils are directly wound against the inside of a hollow, funnel-shaped support whose ends have grooves for guiding the wire conductors.

What is claimed is:

1. An electromagnetic deflection unit for use in a projection television display tube having a display end with a display screen facing an electron gun at an opposed gun end, comprising:

a system of line deflection coils for deflecting the electron beam in the display tube in the horizontal direction, which system comprises two oppositely located saddle coils each having longitudinal conductor groups which are to be positioned on either side of the longitudinal axis of the display tube, characterized in that at the screen end the conductor groups of the oppositely located saddle coils on one side of the tube axis are located at a first distance from each other and on the other side are located at a second, smaller distance from each other, and in that at the gun end the conductor groups of the oppositely located saddle coils on said one side of the tube axis are located at a third distance from each other and on said other side are located at fourth distance from each other which is larger than said third distance, the distances at the screen end being adjusted to generate a 4-pole component upon energisation of the system of line deflection coils, which component renders the raster to be written on the display screen tapezoidal, and the distances at the gun end being adjusted to generate a 4-pole component which is opposite to the 4-pole component generated in the proximity of the screen end.

2. A deflection unit as claimed in claim 1, characterized in that the saddle coils of the line deflection coil system are formed in a yoke-winding technique.

3. An electromagnetic deflection unit as in claim 1, wherein each saddle coil defines a coil window, the centers of the coil windows at said gun end being offset to said one side of said tube axis, the centers of the coil windows at said screen end being offset to said other side of said tube axis.

4. An electromagnetic deflection unit as in claim 1, wherein said third distance is smaller than said first distance.

5. An electromagnetic deflection unit as in claim 1, wherein said fourth distance is larger than said second distance.

* * * * *